US010329718B2

(12) United States Patent
Szekely

(10) Patent No.: US 10,329,718 B2
(45) Date of Patent: Jun. 25, 2019

(54) MODULAR PLATFORM DECK FOR TRAFFIC

(71) Applicant: ASTRA CAPITAL INCORPORATED, Mississauga (CA)

(72) Inventor: Kenneth Szekely, Mississauga (CA)

(73) Assignee: ASTRA CAPITAL INCORPORATED, Mississauga (CA)

( * ) Notice: Subject to any disclaimer, the term of this patent is extended or adjusted under 35 U.S.C. 154(b) by 0 days.

(21) Appl. No.: 15/970,343

(22) Filed: May 3, 2018

(65) Prior Publication Data

US 2018/0327979 A1 Nov. 15, 2018

Related U.S. Application Data

(60) Provisional application No. 62/503,574, filed on May 9, 2017.

(51) Int. Cl.

| | |
|---|---|
| ***E01D 18/00*** | (2006.01) |
| ***E01C 5/22*** | (2006.01) |
| ***E01C 3/00*** | (2006.01) |
| ***E01C 11/00*** | (2006.01) |
| ***E01C 11/24*** | (2006.01) |
| ***E01C 11/26*** | (2006.01) |
| ***E01C 15/00*** | (2006.01) |
| ***E01C 19/52*** | (2006.01) |
| ***E02D 7/22*** | (2006.01) |
| ***E02D 9/00*** | (2006.01) |

(Continued)

(52) U.S. Cl.

CPC ..... *E01C 5/223* (2013.01); *E01C 3/00* (2013.01); *E01C 3/006* (2013.01); *E01C 3/06* (2013.01); *E01C 11/00* (2013.01); *E01C 11/16* (2013.01); *E01C 11/24* (2013.01); *E01C 11/265* (2013.01); *E01C 15/00* (2013.01); *E01C 19/52* (2013.01); *E02B 3/122* (2013.01); *E02D 7/22* (2013.01); *E02D 9/00* (2013.01); *E02D 17/20* (2013.01); *E01C 2201/20* (2013.01)

(58) Field of Classification Search

CPC ..... E01D 5/001; E01D 5/223; E01D 18/00; E01C 5/001; E01C 5/223

USPC ..... 14/73; 404/18, 28, 31, 43

See application file for complete search history.

(56) References Cited

U.S. PATENT DOCUMENTS 5,409,192 A * 4/1995 Oliver ..... E04B 1/34352 248/357

5,906,077 A * 5/1999 Andiarena ..... E04H 12/2223 135/118

(Continued)

*Primary Examiner* — Gary S Hartmann

(74) *Attorney, Agent, or Firm* — Hodgson Russ LLP

(57) ABSTRACT

A modular assembly and method of installing a modular assembly is provided. The modular assembly can include a plurality of base members made of a plastic material, each base member including a top surface and a bottom surface opposite of the top surface, the bottom surface defining channels. A plurality of support members can be provided, each of the plurality of support members may extend across the plurality of base members and disposed within the channels of the plurality of base members. A mounting bracket can be configured to mount each of the plurality of support members to a metal plate of a lower support structure, the metal plate being received by a clamp of the mounting bracket. Each of the plurality of base members can adjoin one another to form a horizontal platform for traffic.

18 Claims, 18 Drawing Sheets

(51) Int. Cl.

| | |
|---|---|
| ***E02D 17/20*** | (2006.01) |
| ***E01C 3/06*** | (2006.01) |
| ***E01C 11/16*** | (2006.01) |
| ***E02B 3/12*** | (2006.01) |

(56) References Cited

U.S. PATENT DOCUMENTS

| | | | | |
|---|---|---|---|---|
| 6,715,956 | B1 * | 4/2004 | Weber | E01C 5/20 404/18 |
| 7,000,279 | B2 * | 2/2006 | Szekely | E01C 11/24 14/69.5 |
| 8,967,904 | B1 * | 3/2015 | Bub | A61H 3/066 404/19 |
| 9,133,588 | B2 * | 9/2015 | Stroyer | E01D 2/00 |
| 9,408,772 | B2 * | 8/2016 | Bub | A61H 3/066 |
| 2001/0025465 | A1 * | 10/2001 | Osfolk | E02B 3/068 52/650.3 |
| 2007/0186498 | A1 * | 8/2007 | Buzon | E04B 5/12 52/263 |

* cited by examiner

MODULAR PLATFORM DECK FOR TRAFFIC

CROSS-REFERENCE TO RELATED APPLICATIONS

This application claims priority to U.S. Provisional Application No. 62/503,574, filed on May 9, 2017, the entire disclosure of which is incorporated herein by reference.

FIELD OF THE DISCLOSURE

The present disclosure relates to modular platforms.

BACKGROUND OF THE DISCLOSURE

In areas where there is pedestrian and vehicular traffic, particularly in publicly-accessible areas, it is common to have specific pedestrian pathways, such as walkways. Such walkways might include sidewalks, pedestrian or vehicular bridges, pedestrian and vehicle ramps, paved walkways through parks, patios, floor surfaces, balconies and the like. Such pedestrian walkways exist in public transit facilities (e.g., subway stations), light rapid transit, bus rapid transit, railway stations, and other locations where there is pedestrian traffic. In many types of pedestrian walkways, there is a requirement for pedestrians to be able to safely navigate such walkways and to remain on the walkways, especially where public transit vehicles are passing closely by. This is particularly important for mass transit platforms near, for example, subways, buses, or trains where there is a need for safe pedestrian walkways.

Besides specific pathways for pedestrians, there can be a need for pedestrians to be able to maintain good traction on pedestrian walkways in order to prevent slips and falls, particularly on outdoor surfaces that can be subject to inclement weather such as wind, rain, snow, or ice.

Additionally, it may be important for pedestrians to be able to determine the presence of platform edges so that the pedestrians do not accidentally walk off the edge of a platform, especially if a vehicle might be passing by. This may be especially important in mass transit situations, and particularly for subways or commuter trains, where the side of the subway or train is right at the edge of the platform. The need for making the presence of platform edges easy to determine may be of particular importance when making such facilities accessible and safe for blind or visually impaired persons.

Conventional concrete and wooden transit platforms may have a durability problem due to degradation by environmental chemicals such as salt, urea, acid rain, oils, and greases as well as stray electrical currents. This necessitates regular maintenance and periodic replacement of the platforms at considerable cost and service disruption to transit authorities. Steel and concrete are also susceptible to corrosive elements, such as water, salt water, and agents present in the environment like acid rain, road salts, or chemicals. Environmental exposure of concrete structures leads to pitting and spalling in concrete and thereby results in severe cracking and a significant decrease in strength in the concrete structure. Steel is likewise susceptible to corrosion, such as rust, by chemical attack. The rusting of steel weakens the steel, transferring tensile load to the concrete, thereby cracking the structure. The rusting of steel in standalone applications requires ongoing maintenance, and after a period of time corrosion can result in failure of the structure. The planned life of steel structures is likewise reduced by rust. Wood has been another long-time building material for bridges and other structures. Wood, like concrete and steel, is also susceptible to environmental attack, especially by rot from weather and termites. In such environments, wood encounters a drastic reduction in strength which compromises the integrity of the structure. Moreover, wood undergoes accelerated deterioration in structures in marine environments, and is susceptible to fire damage.

Concrete structures are typically constructed with the concrete poured in situ as well as using some preformed components pre-cast into structural components (e.g., supports) and transported to the site of the construction. Constructing such concrete structures in situ requires hauling building materials and heavy equipment and pouring and casting the components on site. This process often requires the use of cranes, which can be costly and difficult to use in the case of nearby overhead wires. The weight of concrete structures also increase the necessary foundational requirements, which can increase cost, complexity and time of construction. Consequently, this process of construction involves lengthy construction times and is generally costly, time consuming, subject to delay due to weather and environmental conditions, and disruptive to existing traffic patterns.

Pre-cast concrete structural components are extremely heavy and bulky. Therefore, these are typically costly and difficult to transport to the site of construction due in part to their bulkiness and heavy weight. Although construction time is shortened as compared to poured in situ, extensive time, with resulting delays, is still a factor. Construction with such pre-cast forms is particularly difficult, if not impossible, in areas with difficult access or where the working area is severely restricted due to adjoining tracks, buildings, or platforms. In typical pre-cast concrete construction, tolerances of plus or minus one-quarter inch or more are common, making precise installation and alignment difficult. Pre-cast components may also require the addition of a topping surface to create a finished, level surface.

There is a need for a lightweight structure to facilitate installation in areas with difficult access and/or restricted working areas. In addition, a lightweight structure eliminates the costly concrete foundations and steel support systems necessary to support conventional concrete platforms.

Therefore, an improved modular assembly, such as for a transit platform, is needed.

SUMMARY OF THE DISCLOSURE

The present disclosure provides for a modular assembly. The modular assembly can include a plurality of base members made of a plastic material, each base member including a top surface and a bottom surface opposite of the top surface, the bottom surface defining channels. A plurality of support members can be provided, each of the plurality of support members may extend across the plurality of base members and disposed within the channels of the plurality of base members. A mounting bracket can be configured to mount each of the plurality of support members to a metal plate of a lower support structure, the metal plate being received by a clamp of the mounting bracket. Each of the plurality of base members can adjoin one another to form a horizontal platform for traffic.

The present disclosure also provides for a method of installing a modular assembly. A plurality of base members made of a plastic composite material can be provided. Each base member may include a top surface and a bottom surface opposite of the top surface. The bottom surface can define channels. A plurality of support members can be provided. Each of the plurality of support members can extend across the plurality of base members and be disposed within the channels of the plurality of base members. A metal plate of a lower support structure can be clamped to the plurality of support members with a mounting bracket to form a horizontal platform for traffic.

The lower support structure can be formed by drilling a plurality of helical piles into soil. The plurality of helical piles can be cut to a desired height. Respective lower support surfaces of adjustable leveling mechanisms can be welded to each of the plurality of helical piles. Respective upper support surfaces of each of the adjustable leveling mechanisms can be fastened to an I-beam. The metal plate of the lower support structure can be formed from an upper flange of the I-beam A plurality of fasteners can extend between the upper support surface and the lower support surface. A vertical height of each of the adjustable leveling mechanisms can adjust by moving a support element along the plurality of fasteners. The support element can support the upper support surface and/or the lower support surface. The upper support surface and the lower support surface can also include a plurality of elongated apertures that receive the plurality of fasteners. The plurality of fasteners can be laterally slidable along the apertures to adjust a horizontal position of the upper support surface relative to the lower support surface.

DESCRIPTION OF THE DRAWINGS

For a fuller understanding of the nature and objects of the disclosure, reference should be made to the following detailed description taken in conjunction with the accompanying drawings, in which.

DETAILED DESCRIPTION OF THE DISCLOSURE

Although claimed subject matter will be described in terms of certain embodiments, other embodiments, including embodiments that do not provide all of the benefits and features set forth herein, are also within the scope of this disclosure. Various structural, process step, and electronic changes may be made without departing from the scope of the disclosure.

A modular assembly for decks, panels, platforms, boardwalks, floors, and the like is provided. The modular assembly is mounted on supporting members. In particular, the modular assembly may be used with a transit platform, such as at a train, subway, or bus station.

The modular assembly disclosed herein is easier to assemble than a concrete platform. Compared to existing systems, the modular assembly is preformed, easy to install, and easy to remove or replace. The modular assembly can be assembled or replaced quickly, which minimizes disruptions. Assembly or replacement can be easily performed even in areas with difficult access and/or restricted working areas. The modular assembly may be made of a lightweight, strong, and durable material, such as a composite material.

Furthermore, safety is improved using the modular assembly disclosed herein. In many types of pedestrian walkways, there is a requirement for pedestrians to be able to safely navigate such walkways and to remain on the walkways, especially where public transit vehicles are passing nearby. This may be particularly important for mass transit platforms in public transit facilities. The modular assembly disclosed herein can provide warnings proximate the edges, slip-resistant surfaces, and/or heating systems to melt frost, snow and ice. The modular assembly may also include, or entirely comprise, photoluminescent materials to provide information to pedestrians and/or vehicle operators. For example, exit, safety, warning, and/or related indicators can be included in the surface of the assembly for the purposes of conveying information. Accidents, such as slips and falls, can be prevented and tactile wayfinding can be incorporated.

Figure 1:
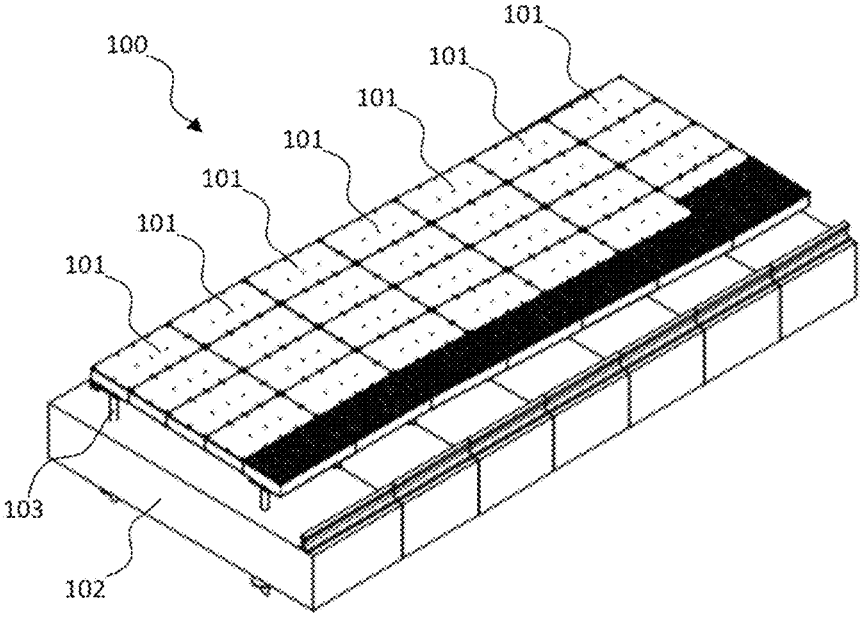
FIG. 1 is a perspective view of an embodiment of a modular assembly on a receiving surface in accordance with the present disclosure.

FIG. 1 is a perspective view of an embodiment of a modular assembly 100 on a receiving surface 102 using piles 103. The modular assembly 100 includes multiple base members 101. The receiving surface 102 may be, for example, a compacted gravel surface, a concrete surface, or other surfaces. The base members 101 can be connected to the piles 103. In an embodiment, the piles 103 are disposed in the ground, which is another example of a receiving surface 102.

While illustrated as approximately rectangular, the base members 101 can be square, polygonal, or other shapes. In one specific embodiment, each base member 101 can have a 2 foot by 4 foot surface and a height of 7 inches.

The base members 101 may be lightweight and water-resistant. In some embodiments the base members 101 can be made of a composite, polymer plastic material, vinyl, rubber, urethane, ceramic, glass reinforced plastic, concrete, or similar materials.

The base member 101 may provide drainage due to their materials or shape. For example, the top surface of the base member 101 may be angled or the base member 101 may include drainage channels or drain pipes that extend through the base member 101.

The base members 101 can be resistant to salt, urea, acid rain, oils, greases, stray electrical currents, or other environment factors. Unlike wood, the base members 101 can be impervious to rot or termites.

Figure 2:
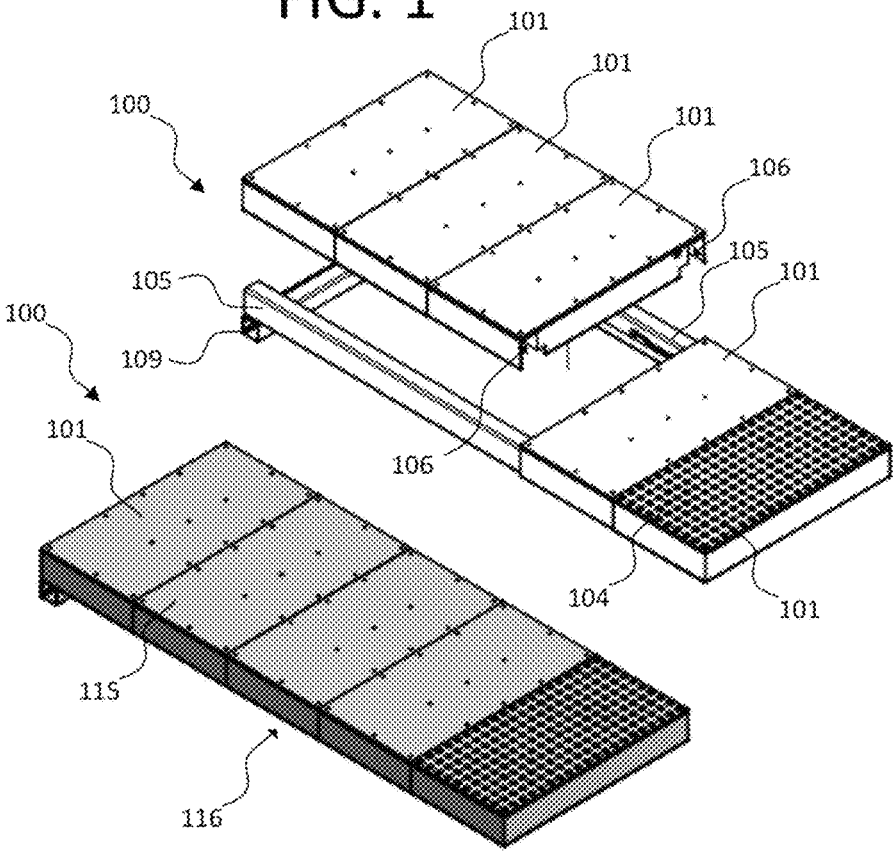
FIG. 2 is a view of an embodiment of a modular assembly in both assembled and partially exploded forms.

FIG. 2 is a view of an embodiment of a modular assembly 100 in both assembled and partially exploded forms. As with FIG. 1, the modular assembly 100 includes multiple base members 101, each with a top surface 115 and an opposite bottom surface 116 that includes the channels 106. In the embodiment of FIG. 2, the modular assembly 100 includes five base members 101, though other numbers and configurations are possible. One of the base members 101 includes a textured surface 104, though more than one of the base members 101 can include the textured surface 104, such as on the top surface 115 that a pedestrian can walk on. The textured surface can vary from the raised cylindrical bumps illustrated and can provide grip for pedestrians and/or a warning to a pedestrian that he or she is, for example, nearing an edge of a platform. Other warnings or benefits are possible. Moreover, other arrays of base members 101 than that illustrated can be arranged in a two-dimensional pattern.

The base members 101 each include two channels 106. Each of the support members 105 are configured to be disposed in one of the channels 106. The support members 105 may be made of a metal, such as a steel or aluminum. The support members 105 can also be made of a non-metal material, such as a composite material, like fiberglass. In alternative embodiments, the surface panel 112 can be formed of a non-composite material such as a tile, concrete, or the like. The support members 105 may be a tube, beam, or other structural element. The support members 105 may be fastened to the base members 101, such as using bolts or screws.

Besides or in conjunction with fasteners, the support members 105 may be clamped to the base members 101 using a mounting bracket or a clamping mechanism. In an example, the support member 105 is an I-beam and the base member 101 is provided with Z clip mounting bracket. The Z clip mounting bracket may be fabricated of stainless steel to resist corrosion.

A wiring raceway 109 is positioned on the support members 105. The wiring raceway 109 can include wires for a heating assembly in the base member 101, electrical lighting wiring, communications wiring, or other wiring.

Figure 3:
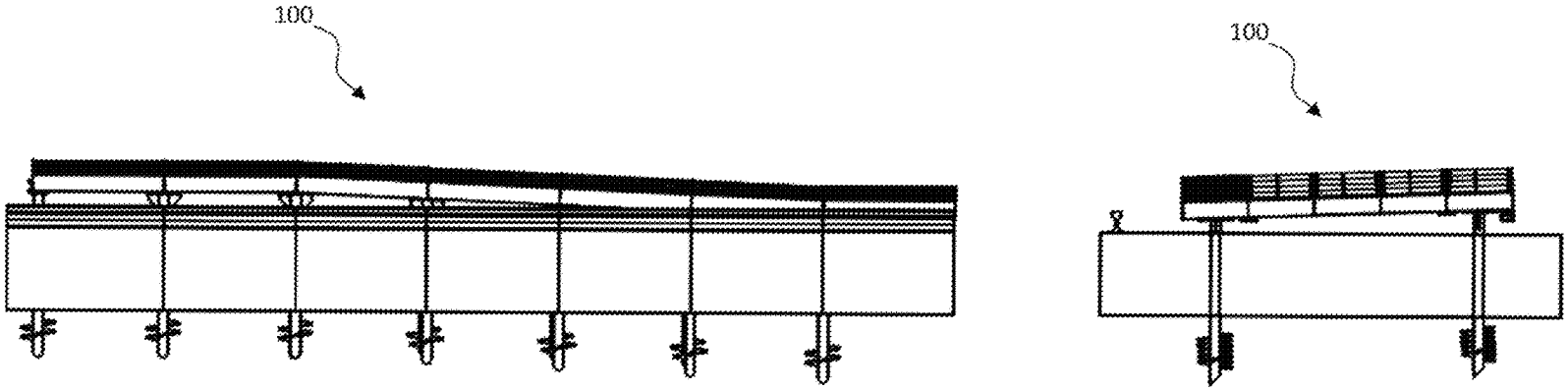
FIG. 3 includes front and side facing views of an embodiment of a modular assembly in accordance with the present disclosure.

FIG. 3 includes front and side facing views of an embodiment of a modular assembly 100. As seen in FIG. 3, the modular assembly 100 can be arranged on a surface with a non-constant grade. The shape of the base members, position of the piles, or the position of individual base members on the piles can be configured to accommodate the non-constant grade.

Piles can be used to anchor the structures into the ground and support the structure above the ground. In one embodiment, conventional foundation piles can be used, where a precast concrete pile or steel beam is driven into a soil bed. In other embodiments, a screw pile may be used to produce a deep foundation that can be installed quickly with minimal noise and vibration. For example, screw piles may be efficiently wound into the ground. This can provide for an efficient means of installation and coupled with their mechanism of dispersing load, may provide effective in-ground performance in a range of soils, including earthquake zones with liquefaction potential. Using this technique, the structures may be above a body of water. The ground may also include artificial supporting fillers, such as concrete. Such structures include buildings, bridges, ramps, decks, panels, platforms, and boardwalks.

Piles can also be installed by pre-drilling a hole in a soil bed using an auger and lowering a pre-molded pile into the hole. A hybrid system also exists between the driving and drilling methods whereby an open ended pile is driven into a soil bed, after which point the soil inside the pile is augured out and concrete is poured in the cavity formed therein. Cast-and-hole methods as well as caissons may also be used, specifically where there are concerns for preserving nearby buildings against the problems discussed above. A pile also can be attached to a drill head which is substantially larger than the diameter of the pile itself. The pile is turned together with the drill head by a drilling rig to create a passage in the soil bed through which the pile may pass. A conduit is provided through the center of the pile for water or grout to be pumped down and out the tip of the drill head to either float away debris or anchor the pile in its final resting place in the soil bed.

Figure 4:
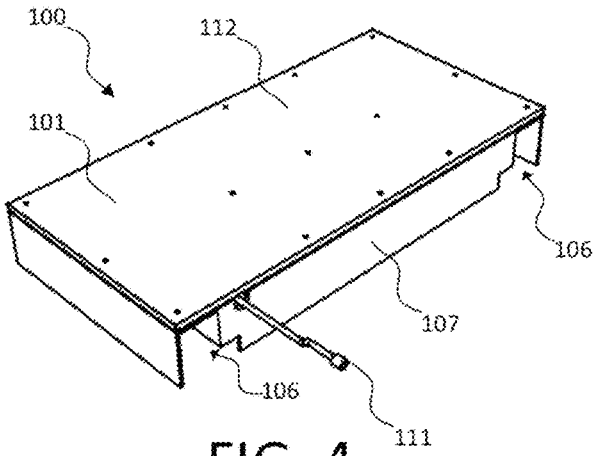
FIG. 4 is a perspective view of a modular assembly with a heater assembly in accordance with the present disclosure.
Figure 5:
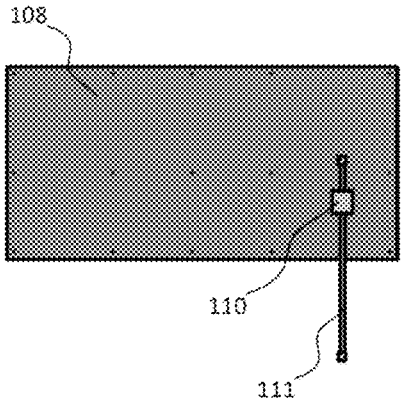
FIG. 5 is a top view of an embodiment of a heater assembly in accordance with the present disclosure.

FIGS. 4 and 5 depict an exemplary modular assembly having a heater assembly 108. The heater assembly 108 can include, for example, an electric silicone heater. Other heaters can be used, including other thin sheet-type electrically powered heaters and heaters sandwiched by a composite material. The heater assembly 108 also can include an electric enclosure 110 and a power cable 111. Some embodiments may also include a grounding plate to avoid or minimize the danger of electrocution or fire in case of a failure of the heater assembly 108. The deck module (i.e., the bottom module) may include a textured top surface and/or may include graphics on the top surface.

Figure 6:
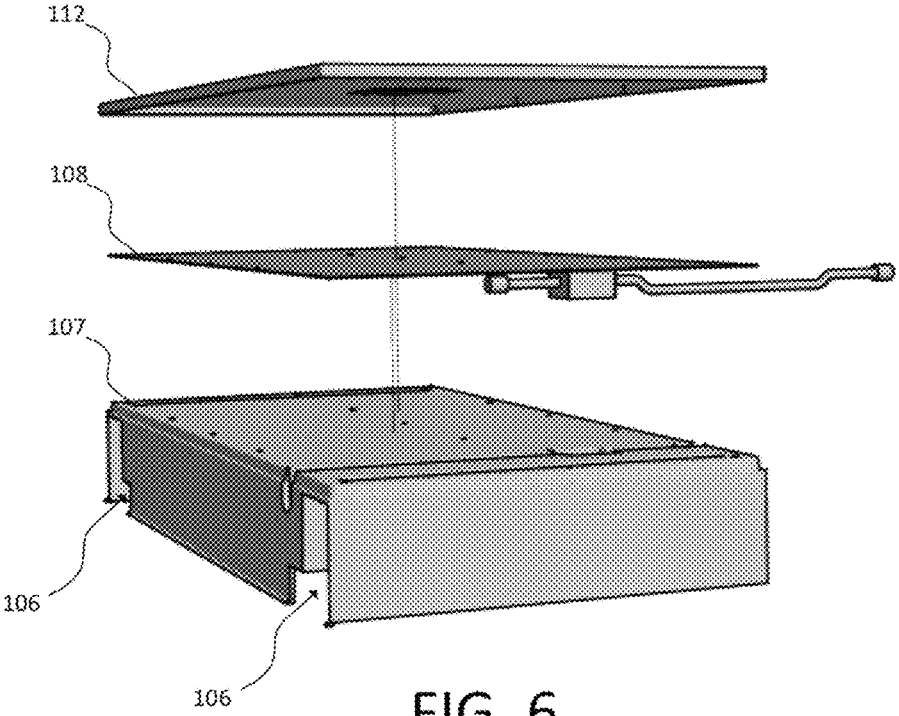
FIG. 6 is an exploded view of the embodiment of FIG. 4.
Figure 7:
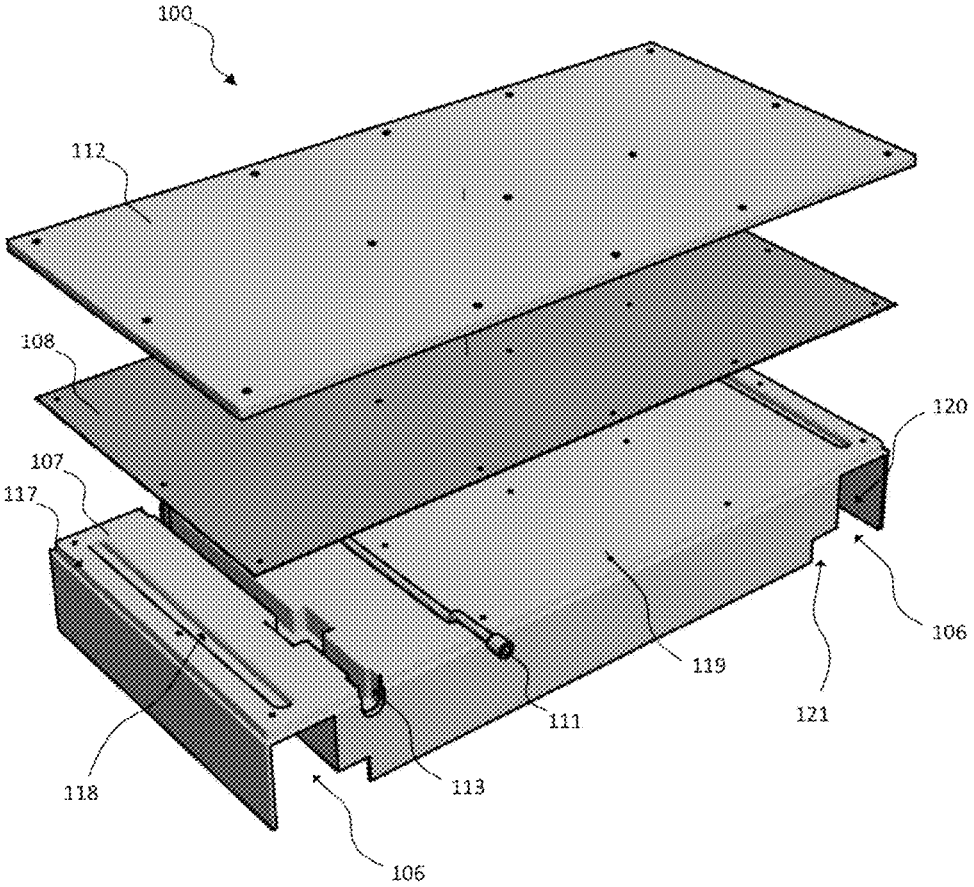
FIG. 7 is another exploded view of the embodiment of FIG. 4.

FIGS. 6 and 7 are exploded views of the embodiment of FIG. 4. The heater assembly 108 can be positioned between the surface panel 112 and the deck module 107. As can be seen in FIG. 7, the deck module 107 may include a cavity 113 that can accommodate, for example, the electric enclosure 110 and/or power cable 111. The deck module 107 and surface panel 112 may be fastened together, such as using bolts or screws. For example, fastener holes 119 (only one of which referred to in FIG. 7 for simplicity) can be used with the fasteners. In yet other embodiments the surface panel 112 can be embedded or recessed into the deck module 107. Channels 106 can include a primary portion 120 and a secondary portion 121. The support member 105 may be positioned in the primary portion 120. One or more fasteners (not shown) may be positioned in groove 118 to connect the deck module 107 to the support member 105 and thereby allow the heater assembly 108 and/or surface panel 112 to rest flush against the deck module 107.

The base member 101 can include a coating that is configured to seal the heater assembly 108 between the deck module 107 and the surface panel 112. This can prevent moisture from impairing operation of the heater assembly 108. The coating may be continuous around the entire base member 101 where the deck module 107 and surface panel 112 meet. Seals or other devices also can be used to prevent the impact of moisture.

In an embodiment, the heater assembly 108 is in direct contact with the surface panel 112 to maximize heat transfer. In another embodiment, an adhesive or filler between the heater assembly 108 and the surface panel 112 is used to provide improved heat transfer.

The deck module 107 may be configured to direct heat toward the surface panel 112. This will preferentially direct heat from the heater assembly 108 toward the surface panel 112. A reflective surface and/or insulation may be used to direct heat away from the deck module 107.

In a particular embodiment, pre-molded insulation or foamed insulation can fill the open spaces of the base member 101, such as between the various internal cross support members of the deck module 107 or in other locations. The insulation precludes heat from the heater assembly 108 from escaping downwardly through the base member 101, thereby allowing for more efficient heating of the surface panel 112. The insulation can be either a low density type of foam or a high density type of foam (e.g., a structural foam) to provide additional structural support. Furthermore, a ceramic layer, can be placed between the surface panel 112 and the deck module 107.

The surface panel 112 on top of the base member 101 may be made a suitable material such as a composite, polymer plastic material, vinyl, rubber, urethane, ceramic, glass reinforced plastic, concrete, or similar materials. The surface panel 112 may include visual indicators or designs (e.g. arrows, warnings, symbols, etc.), and/or graphics (text, logos, advertisements, etc.) thereon. The surface panel 112 may also include or be made of a luminescent material.

The surface panel 112 on top of the base member 101 may include any suitable polymer plastic material or fiber glass type material, and can includes a heat conductive polymer material and/or a heat retentive polymer material. The surface panel 112 may also include a fire retardant. The surface panel 112 may be made according to known composite manufacturing methods, such as being made as a sheet molded compound (SMC), bulk molding composite (BMC), wet compression molding, injection molding, or the like. The heat conductive polymer material allows for quick conduction of heat from the heater assembly 108 through the surface panel 112 and to the exposed surface of the surface panel 112 to permit quick melting of snow and ice. The heat retentive polymer material can retain heat within the heater assembly 108 once the electrical power to the heater assembly 108 has been turned off, thereby allowing for a longer cycle time until electrical power needs to be applied again to retain sufficient heat to melt snow and ice. It is also possible to include small stones, or the like, in the polymer material in order to preclude wearing of the surface panel 112. It should be noted that small stones, aluminum oxide, silica sand, or the like, cannot be included if the surface panel 112 is formed via a compression molding method. It should also be noted that fillers such as the heat conductive polymer material and the heat retentive polymer material may degrade the UV resistance of the resin used to form the surface panel 112. Accordingly, a UV resistant coating can be sprayed on top of the surface panel 112.

A slip-resistant coating may be added to the surface panel 112. The slip resistant coating can be of a non-slip monolithic walking surface. The slip-resistant coating can be resistant to the effects of ultraviolet radiation, temperature changes, and/or corrosive elements such as acids, alkalis, salts, phosphates, organic chemicals, and solvents such as mineral spirits, or gasoline. It also may be sufficiently hard to protect against abrasion, chipping, scratching, or marring. Alternatively, or additionally, an additional structure may be attached to the surface panel, or serve as the surface panel. For example, a concrete layer (e.g. paver) or tile (e.g. porcelain) can be added to the surface panel 112.

Selective heating of the individual base members 101 is possible. For example, base members 101 under a roof may not be heated as much as those not under a roof that may be exposed to snow. In a modular assembly 100, some base members 101 may be heated (sequentially or simultaneously) while other base members 101 are not heated. Selective heating of the base members 101 can also be performed based on one or more sensors embedded within and/or attached to the assembly. Alternatively or additionally, one or more sensors may be located remote from the assembly 100 for the purposes of making a determination to selectively heat base members 100. For example, the one or more sensors can include moisture, temperature, wind, pressure, or the like. Based on information from the one or more sensors (e.g. a determination of snow, ice, or similar precipitation), a controller can be used to automatically heat one or more of the base members 101. This can save on heating costs or can focus heating on areas prone to snow or ice.

Selective heating of the modular assembly 100 also is possible. The timing, duration, and extent of heating can vary for a particular modular assembly 100 placement or design.

Selective heating may use a controller in electrical communication with one or more heater assemblies 108. The controller can be configured to activate, deactivate, and/or change heat settings for individual heaters in the structure assembly 100. The controller can be activated and monitored remotely by Wi-Fi internet communications or cellular network.

Figure 8:
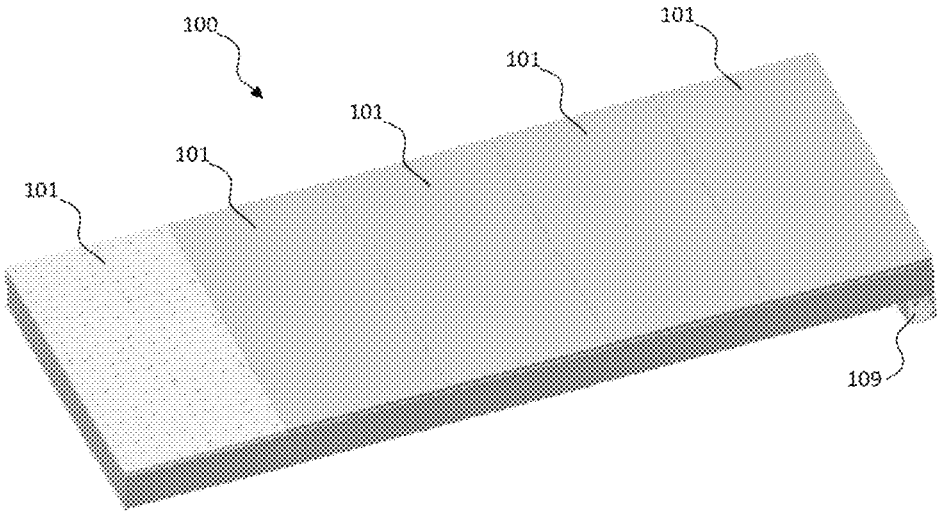
FIG. 8 is a top perspective view of an embodiment of a modular assembly in accordance with the present disclosure.
Figure 9:
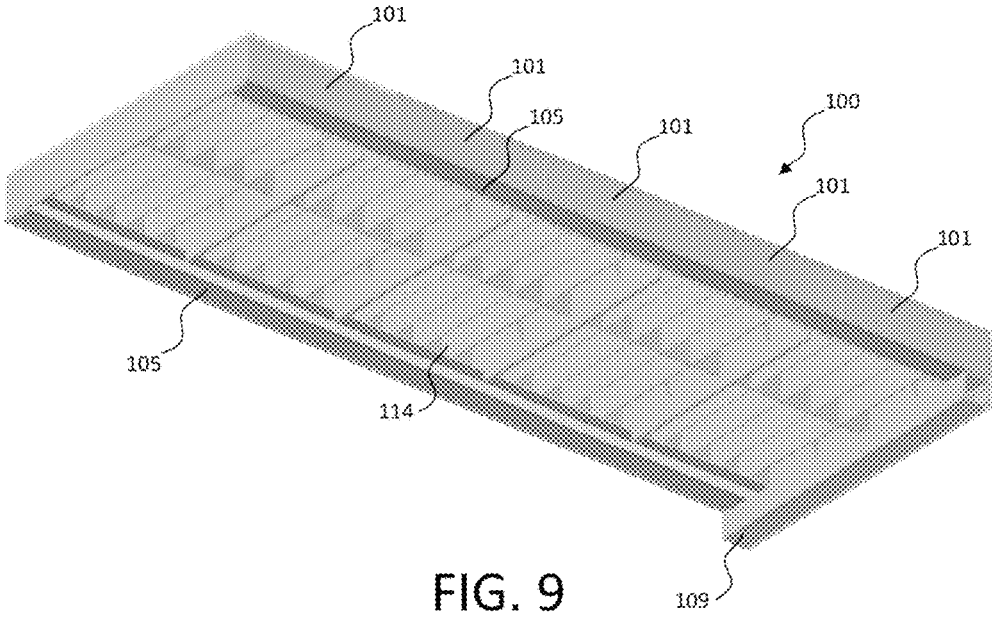
FIG. 9 is a bottom perspective view of an embodiment of a modular assembly in accordance with the present disclosure.

FIG. 8 is a top perspective view of an embodiment of a modular assembly 100 and FIG. 9 is a bottom perspective view of an embodiment of a modular assembly 100. As can be seen in FIG. 9, the bottom of each of the base members 101 can include support ribs 114. The support ribs 114 can provide strength to the base member 101 while providing reduced weight. The support ribs 114 can be in a grid pattern or in other patterns.

The base members 101 can include interlocking mechanisms to fix adjoining base members 101. In one example, the interlocking mechanisms can be tongue and groove designs or other designs. For example, as seen in FIG. 7, the grooves 117 on the edges of the base members 101 can be used as part of an interlocking mechanism. Other shapes of the groove 117 are possible, such as a groove that is positioned over less of the edge of the base member. Multiple interlocking mechanisms also may be used on a single edge of a base member 101, such as including multiple tongue and groove interlocking mechanisms. The interlocking mechanism, such as the groove 117 of a tongue and groove interlocking mechanism, can include a seal to provide a seamless connection between base members 101 and/or to prevent moisture or other materials from falling between the base members 101.

Interlocking mechanisms, such as using one or more tongue and grooves on an edge of a base member 101, can be configured to enable a modular assembly 100 with a surface that includes a non-constant grade. For example, the modular assembly 100 of FIG. 3 can use interlocking mechanisms that are configured to allow for the intersections that provide the non-constant grade. The surfaces of the base members 101 also can be shaped to allow for the intersections that provide the non-constant grade.

Parts of the base members 101 can be made by a compression molding process or method, such as sheet molded compound (SMC) or wet compression molding. Parts of the base members 101 also can be made by pultrusion, hand lay-up, or other suitable methods including resin transfer molding (RTM), vacuum curing and filament winding, automated layup methods, or other methods.

Embodiments of the modular assembly disclosed herein can be assembled in the field or prefabricated. A prefabricated modular assembly may the provided with multiple base members attached to a support member. Thus, a prefabricated base member unit may be provided.

Figure 10:
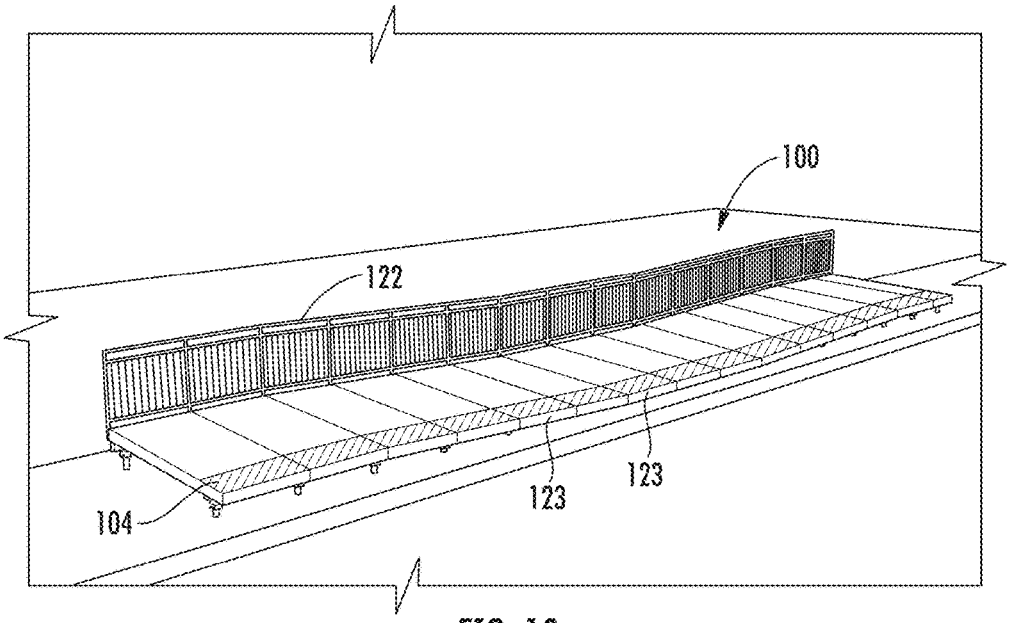
FIG. 10 is a view of an embodiment of a modular assembly.

FIG. 10 is a view of an embodiment of a modular assembly 100 that has been assembled. As seen in FIG. 10, the modular assembly 100 changes elevation and includes a railing 122 and a textured (e.g. tactile) surface 104. The textured surface 104 may be warning tiles. Additional tiles (e.g., armored tiles) may be positioned at the platform edge. In an embodiment, no excavation, wood header, backfilling, or maintenance related to the wood header or asphalt is required. Construction time may be faster than traditional techniques and a snow melt system can be integrated into some or all of the platform.

Figure 11:
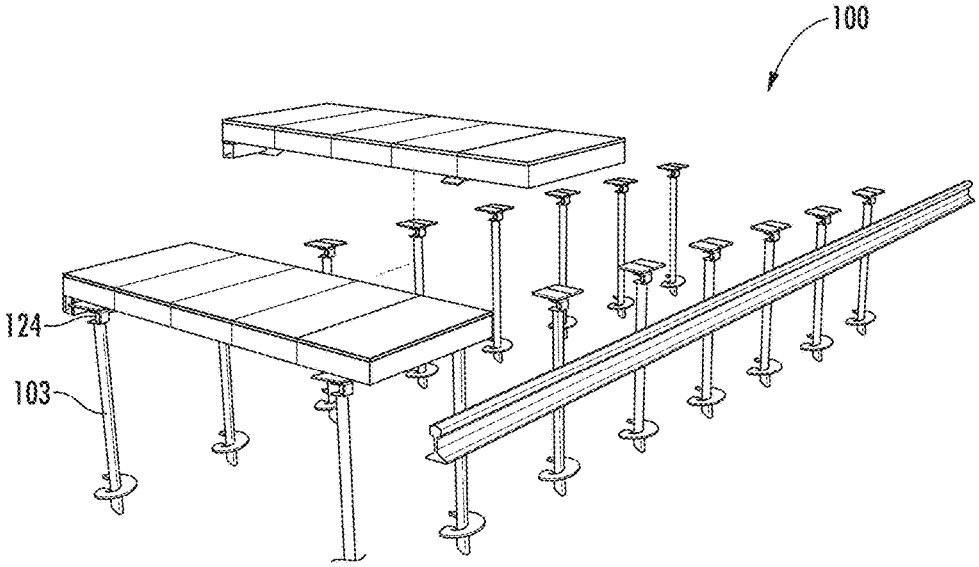
FIG. 11 is an exploded view of a modular assembly on helical piles.
Figure 12:
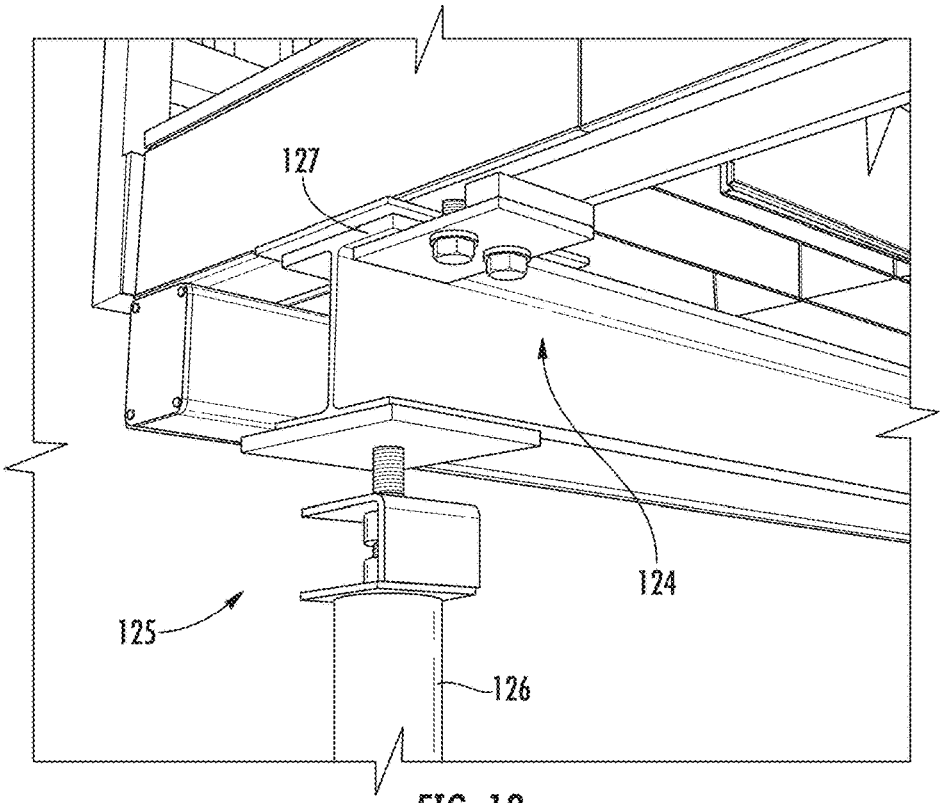
FIG. 12 illustrates a clamp connection to an I-beam.
Figure 13:
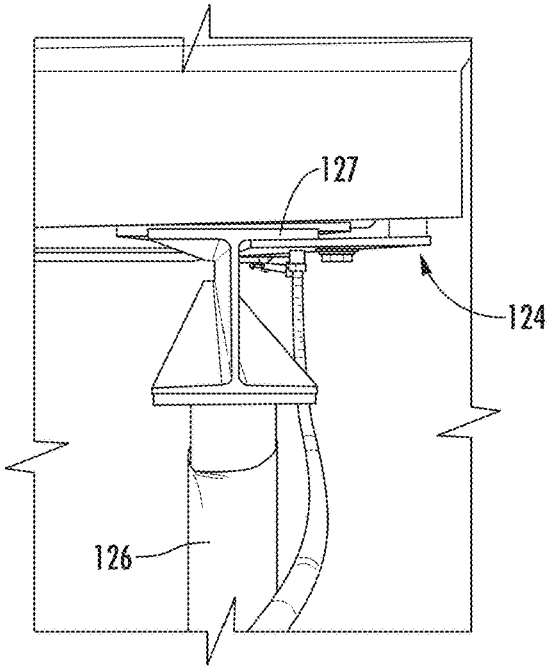
FIG. 13 illustrates a second clamp connection to an I-beam.
Figure 14:
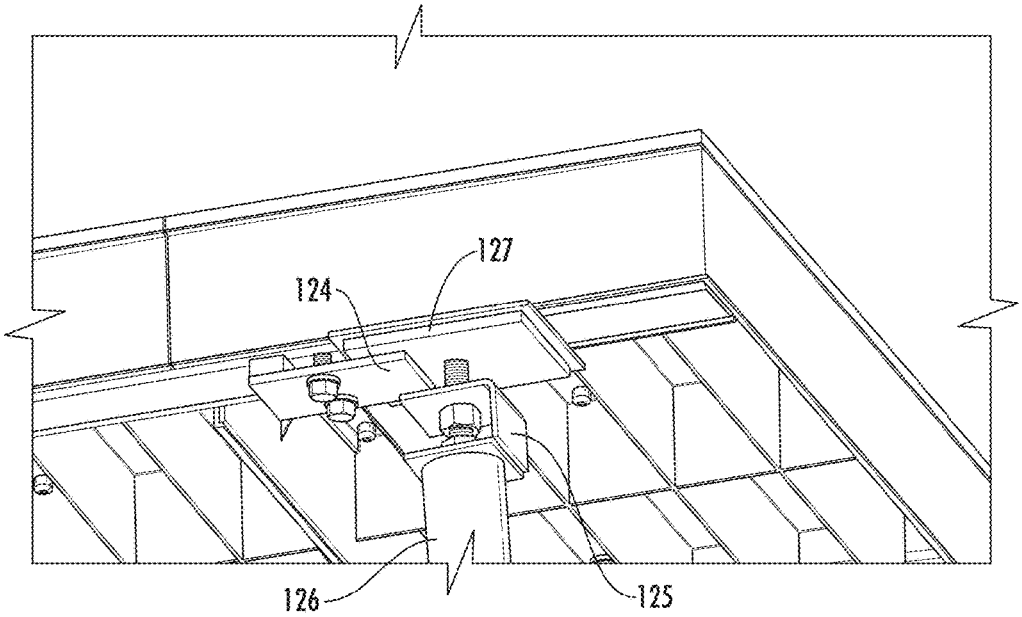
FIG. 14-15 illustrate a leveling mechanism.
Figure 15:
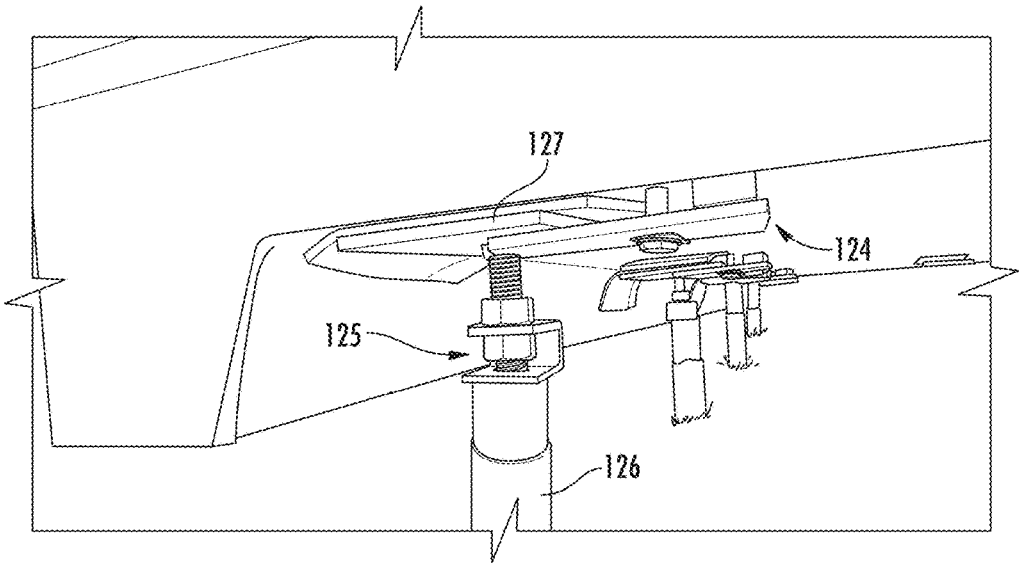

FIG. 11 is an exploded view of a modular assembly 100 on helical piles 103. Helical piles 103 enable a wide range of soil and load applications. Load capacity can be based on torque achieved at installation. An optional height adjustable bearing plate can be included to allow flexibility. For example, a portion of the helical pile 103, and or the mounting bracket 124 may be threaded for the purposes of adjusting the height of the assembly 100.

FIGS. 12-15 illustrate an exemplary mounting bracket 124 and leveling mechanism 125. The mounting bracket 124 can be embodied as a clamp, which fastens a lower support structure 126 to the support member 105. As an example, the mounting bracket 124 can clamp a metal plate 127 of a lower support structure 126, such as a helical pile and/or an I-beam, to the support member 105.

A leveling mechanism 125 can be provided to account for differences in height between the lower support structure (e.g. helical pile) and the support members 105 and/or I-beam. In one example, the leveling mechanism 125 is a threaded connection element of a bearing plate, which allows for in-field adjustment of the height of the helical pile.

Figure 16:
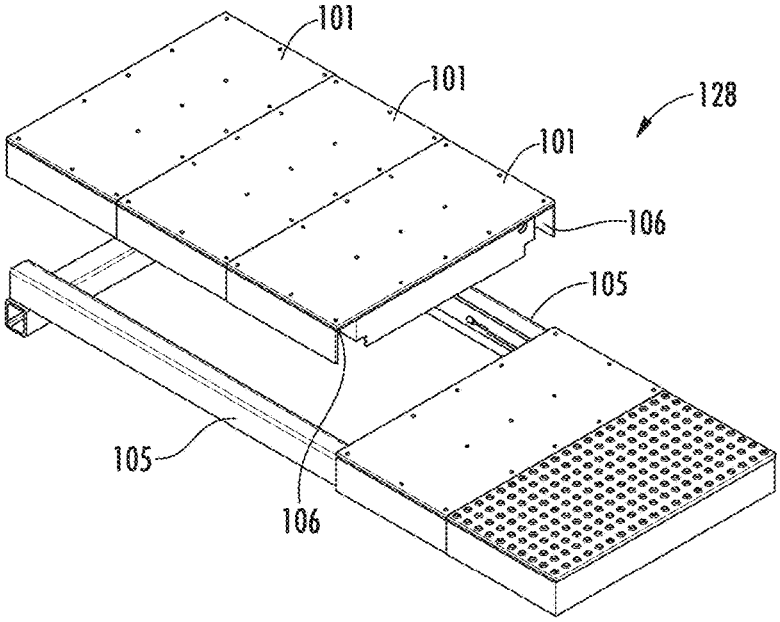
FIG. 16 is a partially exploded view of a base member unit.
Figure 17:
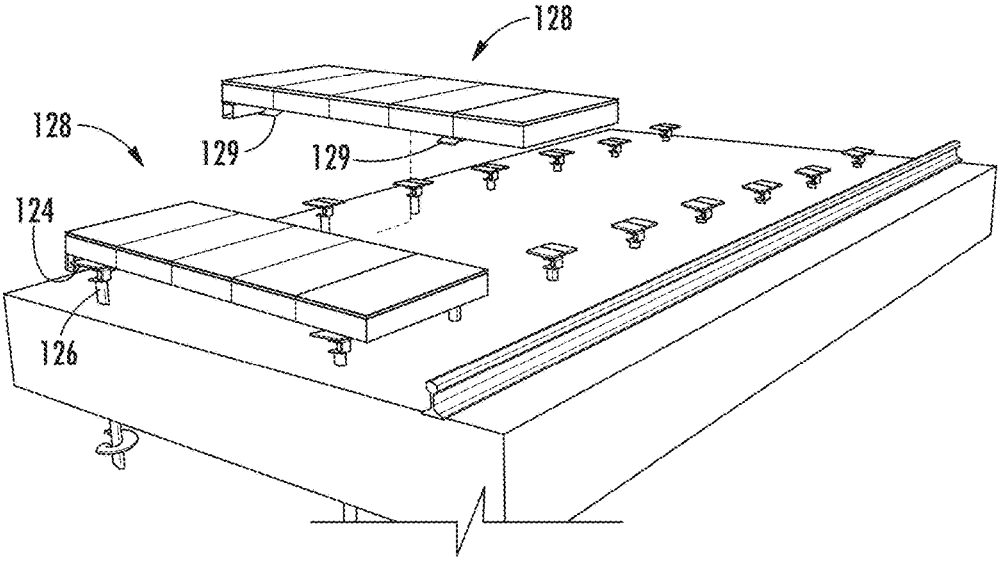
FIG. 17 depicts installation of a modular assembly.

FIGS. 16-17 illustrate installation of a base member to produce a modular assembly 100. A plurality of base members 101 can be positioned on support members 105. Each of the plurality of support members 105 can extend across the plurality of base members 101 and be disposed within the channels 106 of the plurality of base members 101. The base members 101 may be fixed to the support members 105, for example, via fasteners (not shown) to produce a base member unit 128. Each base member unit 128 can be attached to a lower support structure 126, such as a helical pile or an I-beam, for example, by a mounting bracket 124.

As shown in FIG. 17, each base member unit 128 can include one or more alignment plates 129 in order to mechanically join and/or align a base member unit 128 to an adjacent base member unit 128. The alignment plate 129 can form a joint, for example, a shiplap joint. It is alternatively contemplated that adjoining base member units 128 not be mechanically joined, or be fastened together.

Figure 18:
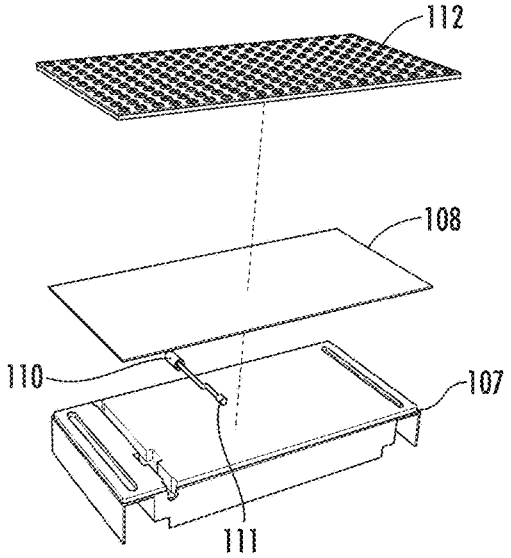
FIG. 18 illustrates the process of accessing a heater assembly.

FIG. 18 illustrates the process of accessing a heater assembly 108 and its related components. Specifically, the surface panel 112 may be removed from the deck module 107. The heater assembly 108, electric enclosure 110, and power cable 111 can be accessed for installation of the heater positioned between the surface panel 112 and the deck module 107.

Figure 19:
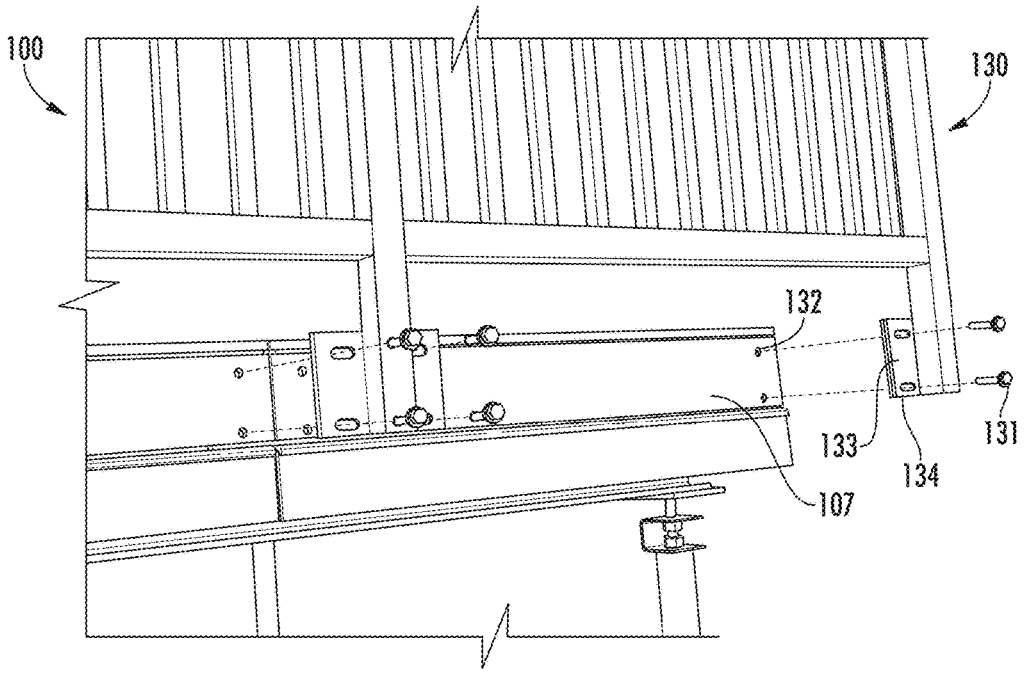
FIGS. 19-20 depicts a railing connection.
Figure 20:
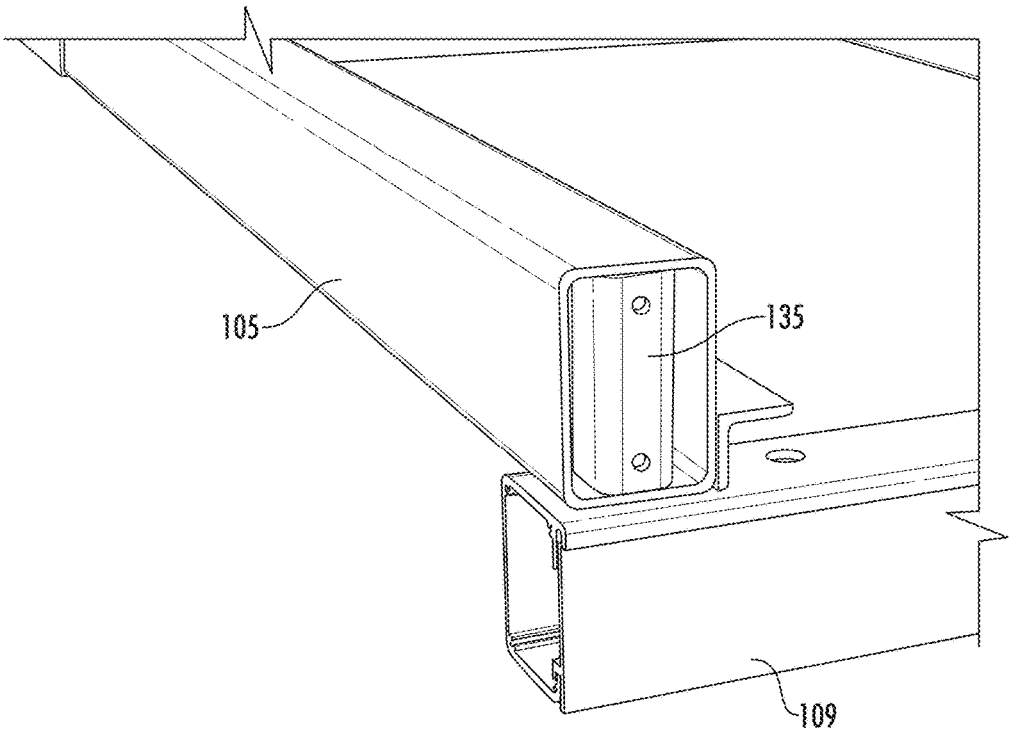

FIGS. 19-20 illustrates the modular assembly 100 receiving a fastened structural element 130, such as a railing connection. According to an embodiment the structural element 130 can be fastened to the support members 105 through the deck module 107. For example, fasteners 131 can pass through apertures 132 in the deck module 107 to fasten the structural element 130 (railing) to the modular assembly 100. The structural element 130 can include a receiving plate 133, including apertures 134, for affixing the structural element 130 to the modular assembly 100. The support member 105 may directly receive the fasteners 131, for example, via a support member receiving plate 135. The support member 105 may also support other structural elements, such as wiring raceway 109, which can be fastened or affixed to a bottom portion of the support member 105. Other examples of fastened elements 130 can include structures or fixtures, such as posts, signage, windbreaks, and the like.

Figure 21:
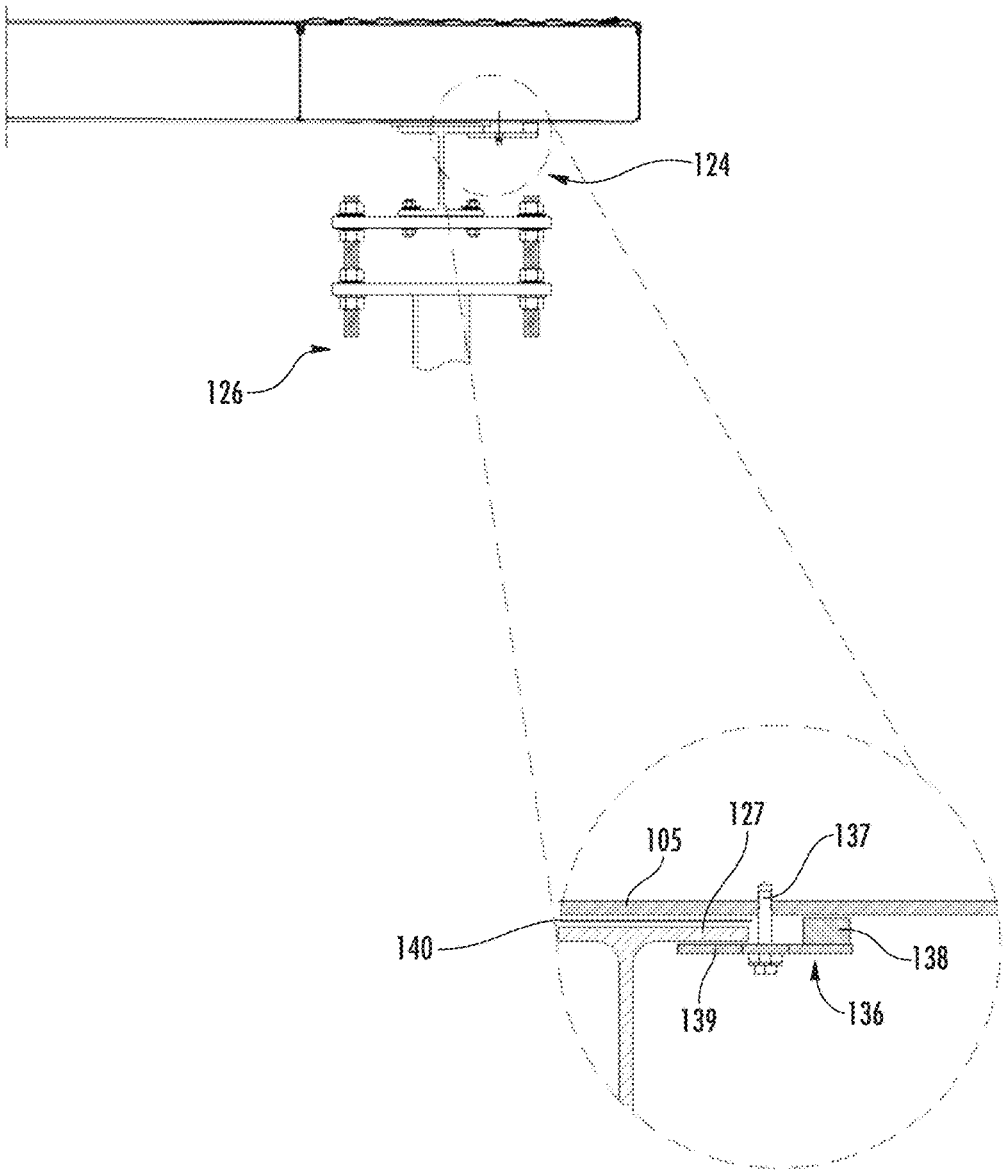
FIG. 21 illustrates another embodiment of a mounting bracket and leveling mechanism.

FIG. 21 illustrates another embodiment of a mounting bracket 124 and leveling mechanism 125. The mounting bracket 124 can include a jaw 136 and a fastener 137. The jaw 136 can have a fulcrum 138 and a bracket 139. The space between the bracket 139 and the support member 105 can define a space for clamping the support member 105 to a metal plate 127 of a lower support structure 126. As an example, the metal plate 127 can be an upper flange of an I-beam or a place attached to a pile. The jaw 136 can be made of a galvanized metal, and be sized 6"×4"×3/16". The fastener 137 can be a stainless steel epoxy coated bolt that extends from the bracket 139 of the jaw 136 through the support member 105. A bearing pad 140, such as a 1/8" neoprene bearing pad, can be positioned between the metal plate 127 and the support member 105.

Figure 22A:
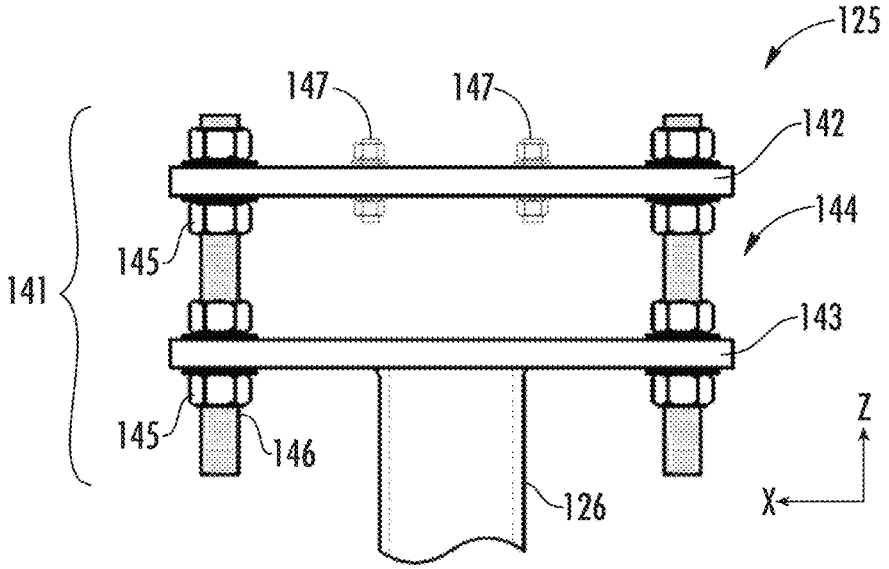
FIGS. 22*a*-22*c* are additional views of a leveling mechanism.

FIGS. **22*a*-22C provide additional views of a leveling mechanism 125 according to an embodiment of the present disclosure. FIG. 22*a* is a side view of a leveling mechanism 125, which includes an adjustment feature 141 for adjusting the height and position of an upper support surface 142 relative to a lower support surface 143. In one example, the lower support surface 143 is fixed to a lower support structure 126 (e.g. by welding to a pile, post, or other support surface) and the upper support surface 142 can be adjusted by adjusting one or more adjustment features of the leveling mechanism. The one or more adjustment features 141 may include a plurality of mechanical elements, such as fasteners, which extend between the upper support surface 142 and the lower support surface 143. In one particular embodiment, the plurality of mechanical elements may be threaded bolts 144. The vertical distance between the upper support surface 142 and the lower support surface 143 can be adjusted by moving a support element 145 of the adjustment features 141 that support the upper support surface 142 and lower support surface 143. In one example, the support element 145 is a threaded nut that threadably attaches to a threaded base 146 of a fastener 144. Rotating the nuts can move the nuts relative to the base to adjust the vertical position of the support surface being supported by the nut. Additional fasteners 147 can be provided on the upper support surface 142 for fastening the base members to the lower support structure. For example, the upper support surface 142 may be fastened to an I-beam that is, in turn, clamped to a mounting bracket 124** of the assembly as previously described.

Figure 22B:
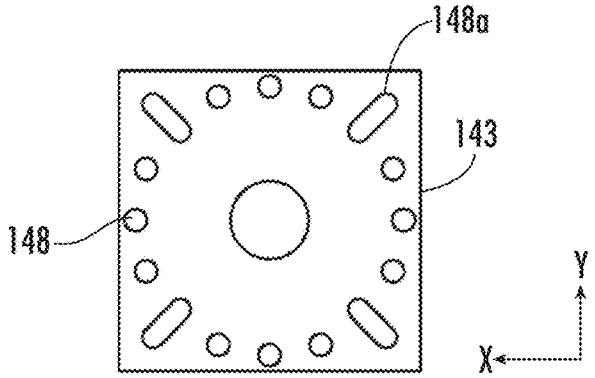
Figure 22C:
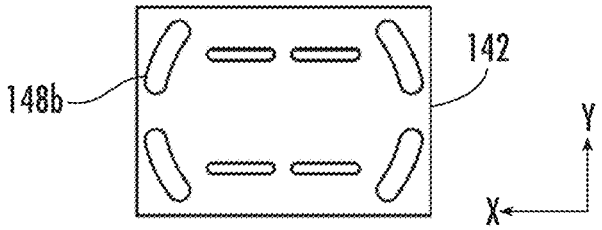

FIGS. 22*b*-22*c* are top views of an exemplary upper support surface 142 and lower support surface 143, which can be embodied as plates having a plurality of apertures 148. The apertures 148 may receive the plurality of mechanical elements (e.g. bolts 144). The apertures 148 may be elongated (e.g. aperture 148*a*) to allow a mechanical element to move relative to the support surface to adjust a horizontal position of the support surface. Similarly, the apertures 148 may be elongated and curved (e.g. aperture 148*b*) for the purposes rotating the support surface relative to the mechanical element. In the depicted examples, the lower support surface 143 includes elongated apertures 148*a* and the upper support surface 142 includes elongated and curved apertures 148*b*. The upper support surface 142 and lower support surface 143 may be plates, and be made of a metal. The upper support surface 142 and lower support surface 143 may be made of different sized and/or shaped plates. In one particular example, the upper support surface 142 is a 15.5"×11"×¾" metal plate and the lower support surface 143 is a 15.5"×15.5"×¾" metal plate.

The leveling mechanism 125 may be used to accommodate spatial differences between the lower support structure 126 (e.g. helical pile) and the support members 105 and/or I-beam. For example, the leveling mechanism 125 may be used to accommodate spatial differences across the longitudinal axis X, lateral axis Y, and/or vertical axis Z. The leveling mechanism 125 may also be used to accommodate rotational differences (e.g. yaw) between the lower support structure 126 and the support members 105. This can be particularly advantageous for situations where the lower support structure 126 cannot precisely be positioned to an acceptable level of accuracy. For example, piles (e.g. a helical pile) can quickly and efficiently produce a lower support structure 126, but positional accuracy of the piles can be difficult to ensure in the field. The leveling mechanisms 125 described herein can accommodate for spatial inaccuracies in an efficient manner. For example, the leveling mechanisms 125 can be adjusted quickly and easily on-site, without the need for more costly or difficult assembly procedures.

Figure 23:
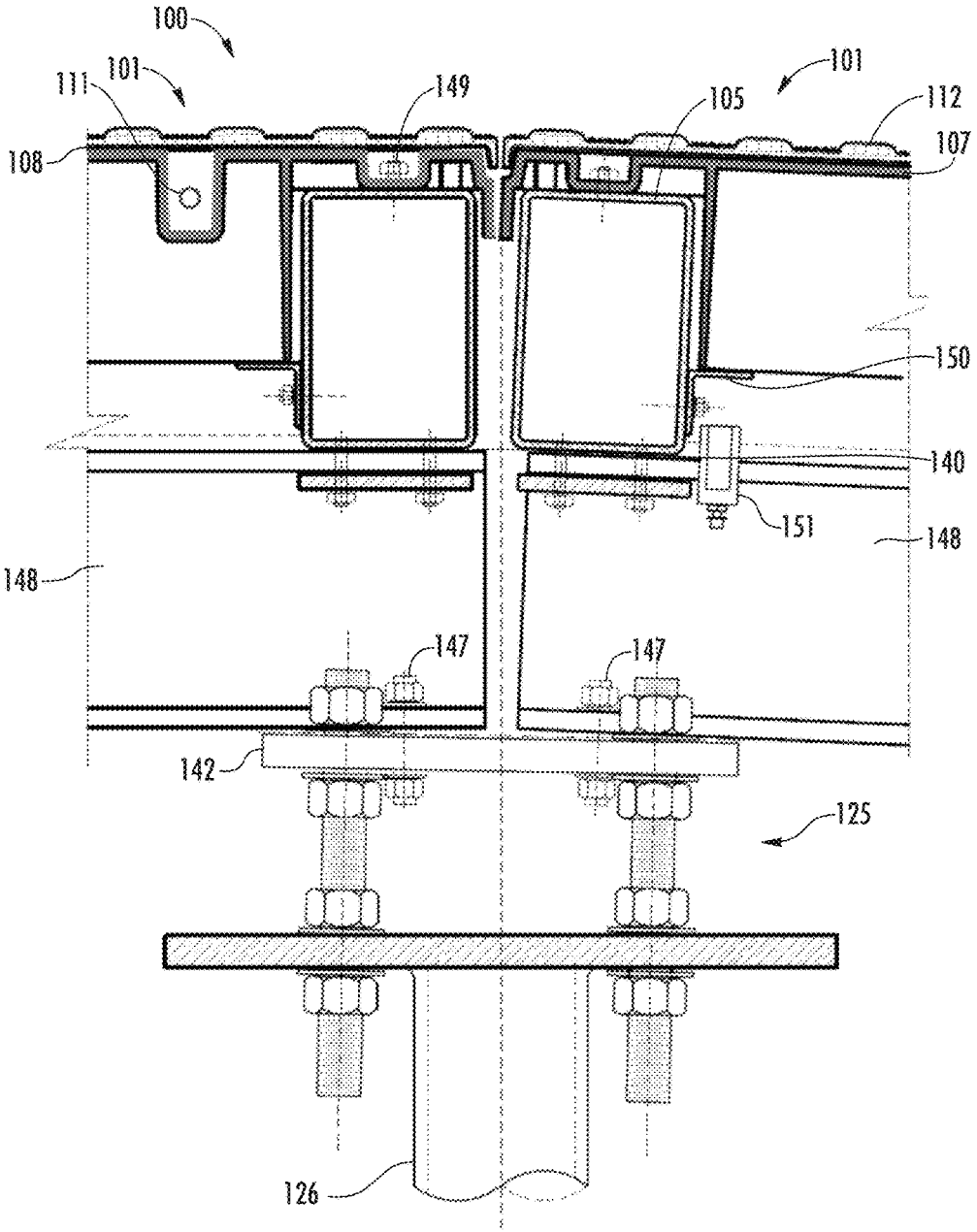
FIGS. 23-24 are cross-sectional views of a modular assembly.

FIG. 23 is a cross-sectional view of a modular assembly 100 where adjoining base members 101 are angled relative to one another to adjust the pitch of a platform created by the base members. Depending on the ultimate application of the modular assembly 100, it may be desired to adjust the pitch so that portions of the platform meet certain height or positional requirements. For example, the pitch may need to be adjusted to meet a train platform crossing, to meet an adjoining structure, or the like. With reference to FIG. 23, the angle of a fastened support member (e.g. support member 105 and/or I-beam 148) can be adjusted by adjusting fasteners 147 and/or shimming (e.g. with a bearing pad). It is also contemplated that an upper support surface 142 can be angled (not shown) to accommodate an angled support member 105 and/or I-beam 148.

FIG. 23 also shows a modular assembly 100 having a base members 101 that include a tactile surface panel 112, a heater assembly 108, a power cable 111 for powering the heater assembly 108, and a deck module 107. Each deck module 107 is fastened to a support member 105 via fasteners 149. An additional support angle 150 can be provided to support a rib 114 of the deck module 107 relative to the support member 105. A mounting bracket 124 can clamp the support member 105 to a lower support structure, such as an I-beam 148. In this way, a mechanical connection can be made without welding and/or without a fastener that extends through the lower support structure. A bearing pad 140 may be provided between the I-beam 148 and the support member 105. A retainer clamp 151 can be provided to temporarily retain the support member 105 relative to the I-beam 148 before the mounting bracket 124 is clamped into position. The retainer clamp 151 can thereby avoid sliding of the support member 105 relative to the I-beam 148. This can be useful during assembly where the base members 101 are not level (e.g. pitched).

The I-beam 148 can be fastened via fasteners 147 to the upper support surface 142 of a leveling mechanism 125. The leveling mechanism can include a lower support surface 143 fixed (e.g. via welding) to a lower support structure 126. The lower support structure can include a pile, such a 4" in diameter pier.

Figure 24:
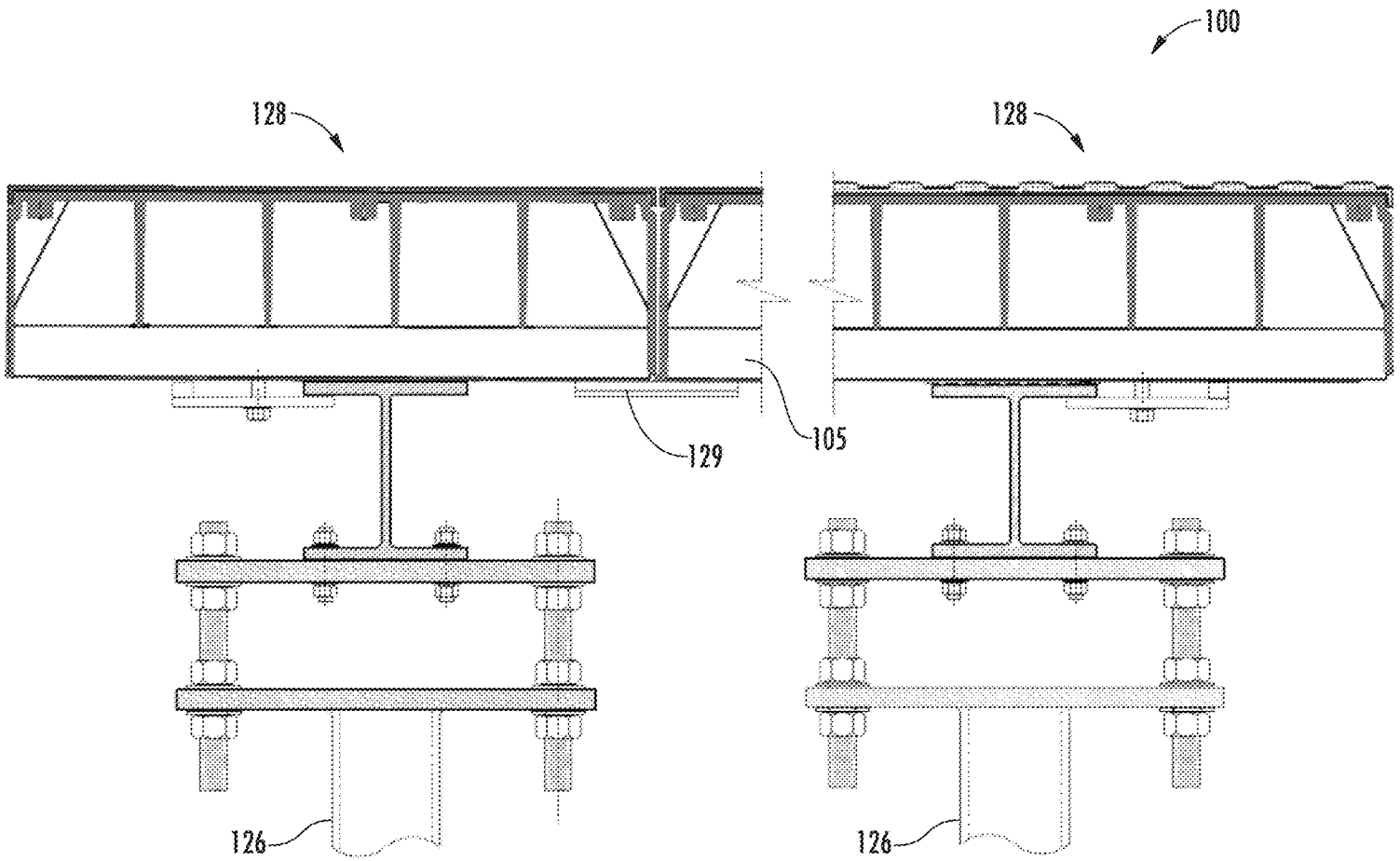

FIG. 24 is a cross-sectional view of a modular assembly 100, including a plurality of base member units 128 respectively supported by support structures 126. Each adjacent base member unit 128 may be mechanically interlocked with one another, for example, by adjoining respective alignment plates 129. The alignment plates 129 may be fixed to the support member 105 an can produce a mechanical lock that can hold adjacent base members 101 relative to one another. Although the alignment plates 129 can be additionally fastened or welded to one another, it is contemplated that the alignment plates 129 can mate with one another without fastening or welding.

Figure 25A:
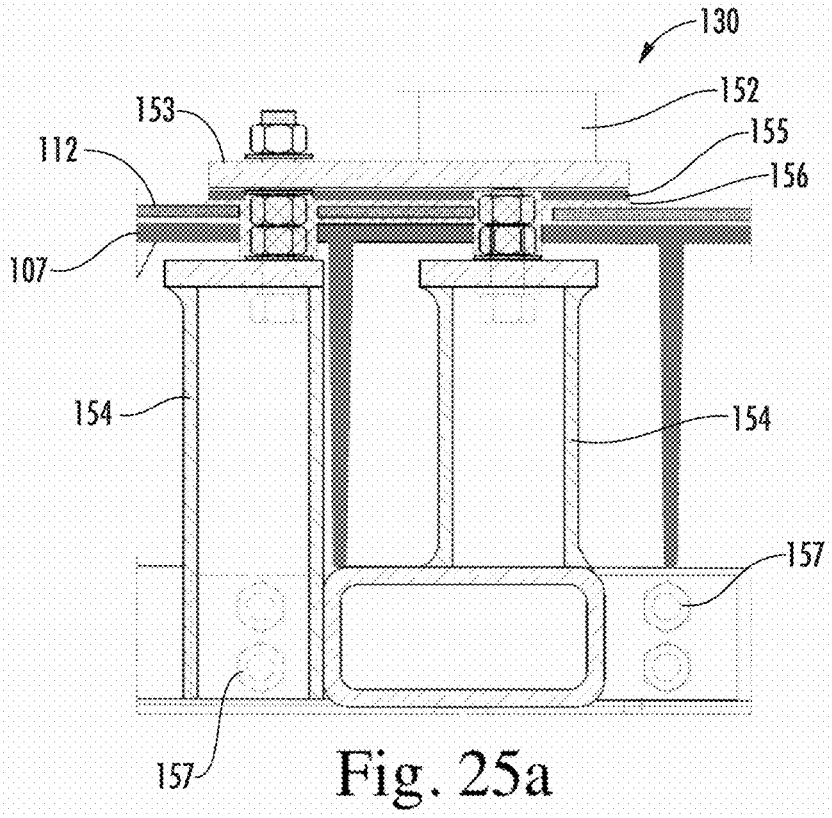
FIGS. 25*a*-25*b* are cross-sectional views illustrating an above-surface structure connected to the modular assembly.
Figure 25B:
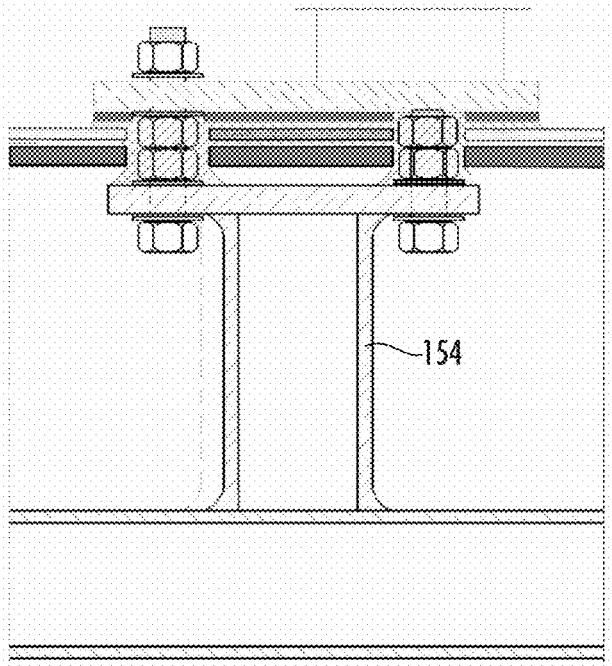

FIGS. 25*a*-25*b* illustrate an above-surface structural element 130 (e.g. structure, fixture, post, signage, or the like) affixed to the modular assembly 100. The structural element 130 can include a vertical structure 152, and a base plate 153. The base plate 153 can be fastened through a surface panel 112 and deck module 107 to a lower support structure 155 via fasteners 156. A layer of fiberglass 155 and/or a sealant 156 can be applied between the base plate 153 and the surface panel 112. The lower support structure 155 can be affixed to an I-beam and/or support member 105 (not shown), for example via fasteners 157.

Figure 26:
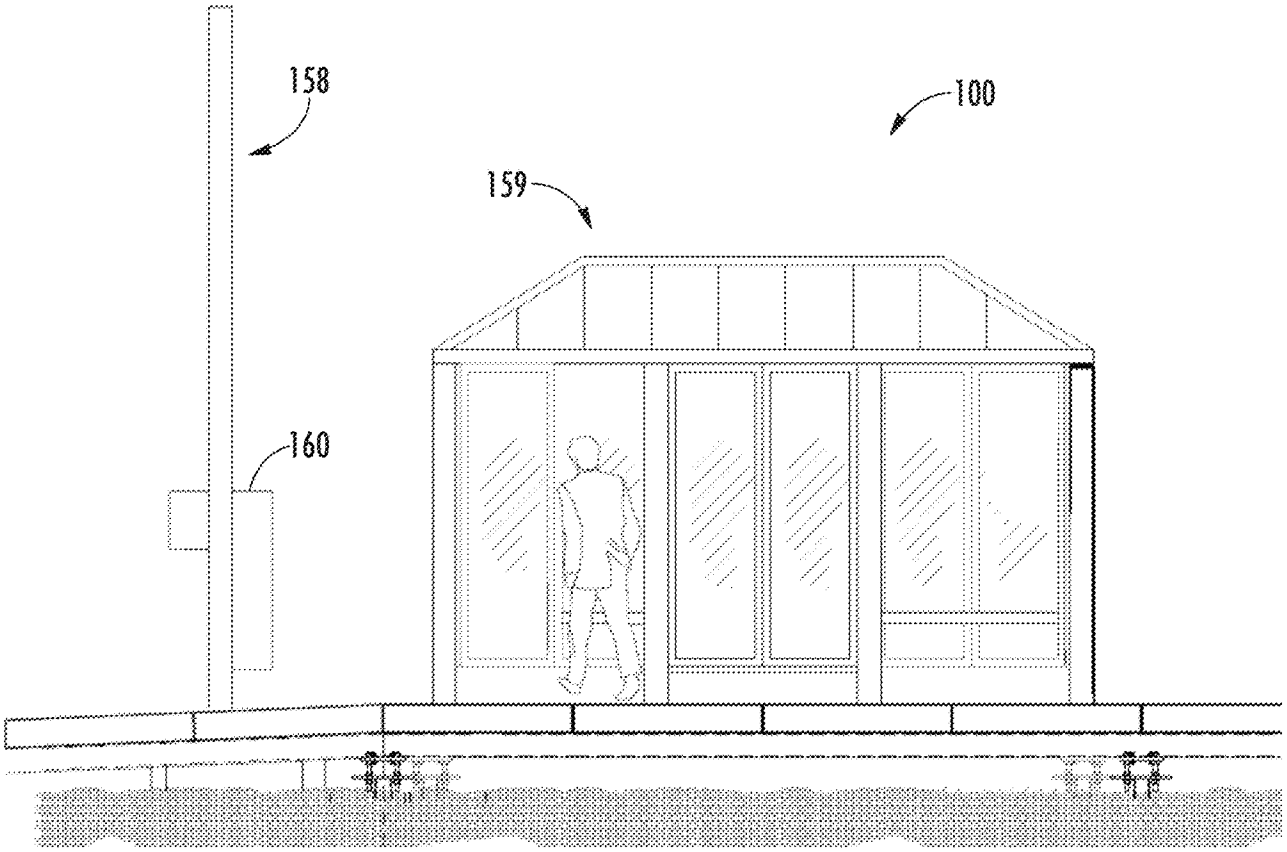
FIG. 26 is an elevation view of a modular assembly having above-surface structures affixed-thereto.

FIG. 26 depicts a modular assembly 100 with exemplary above-surface structural elements 130. Specifically, the modular assembly 100 includes a post 158 and a windbreak 159. The post 158 can be used to hold lighting, sensors, signage, electrical panels, or the like. In one particular example, the post 158 can include a sensor array (not shown) with weather sensors (e.g. wind, temperature, moisture) and an electrical panel 160. The sensor array can be used to control a heater assembly (not shown) disposed in the modular assembly 100 as previously described.

Figure 27:
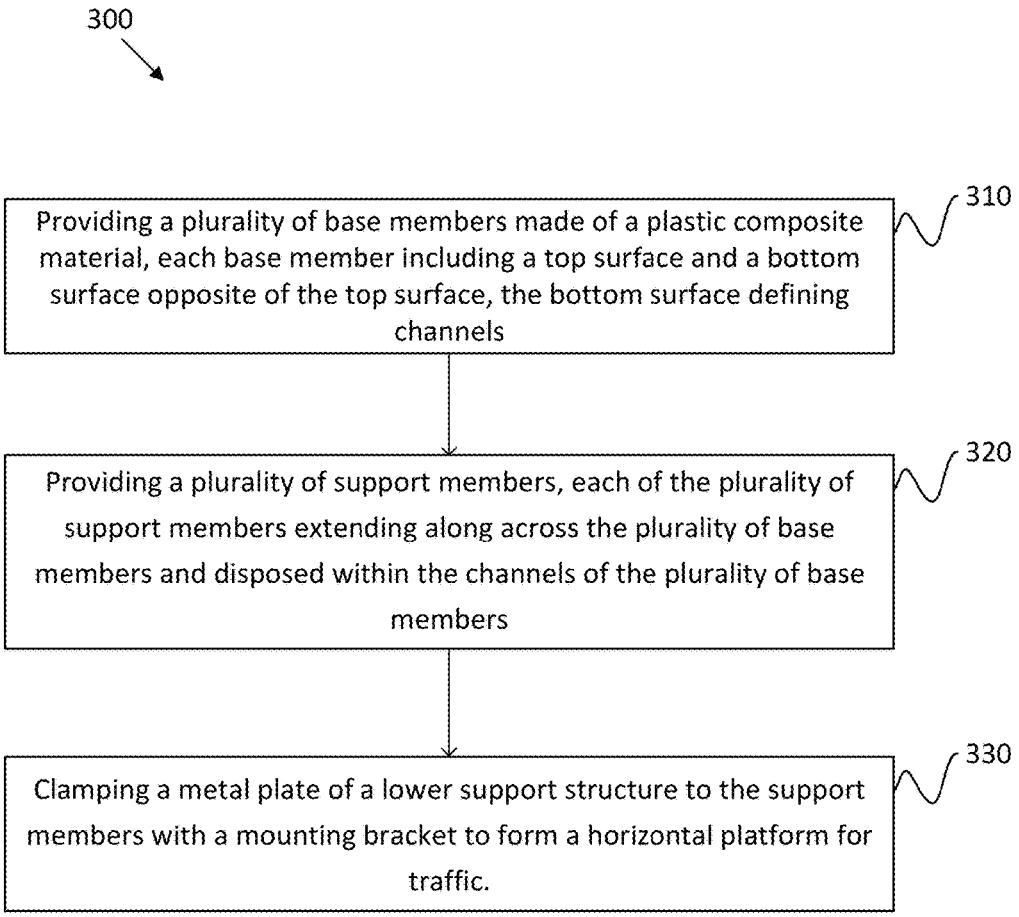
FIG. 27 depicts a method of installing a modular assembly.

FIG. 27 depicts a method of installing a modular assembly according to another embodiment of the present disclosure. The method 300 includes providing 310 a plurality of base members made of a plastic composite material, each base member including a top surface and a bottom surface opposite of the top surface, the bottom surface defining channels. A plurality of support members can be provided 320, each of the plurality of support members extending across the plurality of base members and disposed within the channels of the plurality of base members. A metal plate of a lower support structure can be clamped 330 to the support members with a mounting bracket to form a horizontal platform for traffic.

Variations in design are possible due to the flexibility and relative low cost of tooling used in the manufacturing process. Panel size, length, width, thickness, color, ribbing, and surface profiles can be modified to suit specific project requirements. Drainage details also can be modified to suit specific project requirements.

The embodiments of the modular assembly disclosed herein can solve the problem of durability and premature breakdown of concrete and wood platforms due to degradation. The light weight of the modular assembly facilitates ease of installation in areas which have difficult access and work windows. The modular assembly also solves the problem of dealing with heavy concrete platforms which necessitate the use of costly foundations and steel support systems. These benefits apply to both new and retrofit construction requirements. Reduced maintenance and long life cycles are achieved. The modular assembly can be assembled faster than prior art platforms, and can avoid or significantly reduce welding of component parts.

Although the present disclosure has been described with respect to one or more particular embodiments, it will be understood that other embodiments of the present disclosure may be made without departing from the spirit and scope of the present disclosure.

What is claimed is:

1. A modular assembly, comprising:

a plurality of base members made of a plastic composite material, each base member including a top surface and a bottom surface opposite of the top surface, the bottom surface defining channels;

a plurality of support members, each of the plurality of support members extending across the plurality of base members and disposed within the channels of the plurality of base members; and a mounting bracket configured to mount each of the plurality of support members to a metal plate of a lower support structure, the metal plate being received by a clamp of the mounting bracket;

wherein each of the plurality of base members adjoin one another to form a horizontal platform for traffic;

wherein the metal plate is an upper flange of an I-beam;

wherein the mounting bracket includes a jaw and a fastener, the jaw including a fulcrum and a bracket.

2. The modular assembly of claim 1, wherein the support members are one or more of the following: a steel beam and a steel tube.

3. The modular assembly of claim 1, wherein the base member includes a deck module and a surface panel disposed on the deck module.

4. The modular assembly of claim 3, further comprising a heater assembly disposed between the deck module and the surface panel.

5. The modular assembly of claim 4, wherein the heater assembly includes an electric silicone heater.

6. The modular assembly of claim 4, further comprising a seal configured to seal the heater assembly between the deck module and the surface panel.

7. The modular assembly of claim 4, wherein the deck module includes a heat-reflective material configured to direct heat from the heater assembly toward the surface panel.

8. The modular assembly of claim 4, further comprising a controller and sensor array in electronic communication with the heater assembly, the controller being configured to control heat settings of the heater assembly based upon a weather condition detected by the sensor array.

9. The modular assembly of claim 1, further comprising a plurality of piles, wherein the support members are affixed to the plurality of piles.

10. The modular assembly of claim 1, wherein the top surface includes a tactile surface configured to warn a pedestrian.

11. The modular assembly of claim 1, wherein the top surface includes a slip-resistant coating.

12. The modular assembly of claim 1, further comprising an adjustable leveling mechanism configured to adjust in vertical height, the adjustable leveling mechanism mechanically connected the metal plate to a lower support structure and the metal plate.

13. The modular assembly of claim 12, wherein the adjustable leveling mechanism includes an upper support surface and a lower support surface, the lower support surface being fixed to a lower support structure, and a plurality of fasteners extending between the upper support surface and the lower support surface;

wherein the vertical height of the adjustable leveling mechanism is configured to adjust by moving a support element along the plurality of fasteners, the support element supporting one or more of the following: the upper support surface and the lower support surface.

14. The modular assembly of claim 13, wherein the lower support structure is a pile.

15. The modular assembly of claim 14, wherein the upper support surface and the lower support surface include a plurality of elongated apertures that receive the plurality of fasteners, the plurality of fasteners being laterally slidable along the apertures to adjust a horizontal position of the upper support surface relative to the lower support surface.

16. A method of installing a modular assembly, comprising:

providing a plurality of base members made of a plastic composite material, each base member including a top surface and a bottom surface opposite of the top surface, the bottom surface defining channels;

providing a plurality of support members, each of the plurality of support members extending across the plurality of base members and disposed within the channels of the plurality of base members;

clamping a metal plate of a lower support structure to the plurality of support members with a mounting bracket to form a horizontal platform for traffic;

wherein the metal plate is an upper flange of an I-beam;

wherein the mounting bracket includes a jaw and a fastener, the jaw including a fulcrum and a bracket.

17. The method of installing a modular assembly of claim 16, wherein the lower support structure is formed by:

drilling a plurality of helical piles into soil;

cutting the plurality of helical piles to a desired height;

welding respective lower support surfaces of adjustable leveling mechanisms to each of the plurality of helical piles;

fastening respective upper support surfaces of each of the adjustable leveling mechanisms to the I-beam.

18. The method of installing a modular assembly of claim 17, wherein a plurality of fasteners extend between the upper support surface and the lower support surface;

wherein a vertical height of each of the adjustable leveling mechanisms is configured to adjust by moving a support element along the plurality of fasteners, the support element supporting one or more of the following: the upper support surface and the lower support surface;

wherein the upper support surface and the lower support surface include a plurality of elongated apertures that receive the plurality of fasteners, the plurality of fasteners being laterally slidable along the apertures to adjust a horizontal position of the upper support surface relative to the lower support surface.

* * * * *